US010400601B2

(12) United States Patent
Lindsey

(10) Patent No.: US 10,400,601 B2
(45) Date of Patent: Sep. 3, 2019

(54) ROTARY PISTON AND CYLINDER DEVICE

(71) Applicant: LONTRA LIMITED, Southam, Warwickshire (GB)

(72) Inventor: Stephen Francis Lindsey, Southam (GB)

(73) Assignee: LONTRA LIMITED, Southam, Warwickshire (GB)

( * ) Notice: Subject to any disclaimer, the term of this patent is extended or adjusted under 35 U.S.C. 154(b) by 44 days.

(21) Appl. No.: 15/328,846

(22) PCT Filed: Jul. 24, 2015

(86) PCT No.: PCT/GB2015/052150
§ 371 (c)(1),
(2) Date: Jan. 24, 2017

(87) PCT Pub. No.: WO2016/012808
PCT Pub. Date: Jan. 28, 2016

(65) Prior Publication Data

US 2017/0211388 A1 Jul. 27, 2017

(30) Foreign Application Priority Data

Jul. 24, 2014 (GB) ..... 1413172.6

(51) Int. Cl.
*F03C 2/00* (2006.01)
*F03C 4/00* (2006.01)
(Continued)

(52) U.S. Cl.
CPC ..... *F01C 3/025* (2013.01); *F01C 19/02* (2013.01); *F02B 55/02* (2013.01); *F02B 53/00* (2013.01)

(58) Field of Classification Search
CPC ..... F01C 3/025; F01C 19/02; F02B 53/00; F02B 55/02
(Continued)

(56) References Cited

U.S. PATENT DOCUMENTS 3,277,832 A * 10/1966 Panie-Dujac ..... F01C 3/02 418/195

FOREIGN PATENT DOCUMENTS

DE 15 53 050 12/1969
DE 195 09 913 9/1996
(Continued)

OTHER PUBLICATIONS

United Kingdom Search Report dated Feb. 23, 2015 in corresponding United Kingdom Application No. 1413172.6.
(Continued)

*Primary Examiner* — Theresa Trieu
(74) *Attorney, Agent, or Firm* — Whiteford, Taylor & Preston, LLP; Peter J. Davis

(57) ABSTRACT

A rotary piston and cylinder device having a rotor, a stator and a shutter disc, the rotor including a piston which extends from the rotor into the cylinder space, the rotor and the stator together defining the cylinder space, the shutter disc passing through the cylinder space and forming a partition, and the disc having a slot which allows passage of the piston, the shutter disc having a circumferential surface that forms a seal with the rotor, the circumferential surface defining at least one close running line with the rotor, and the at least one close-running line offset from a rotor plane which lies on a radius of the rotor and which includes the axis of rotation of the rotor.

18 Claims, 13 Drawing Sheets

(51) Int. Cl.

| | |
|---|---|
| ***F04C 18/00*** | (2006.01) |
| ***F01C 3/02*** | (2006.01) |
| ***F01C 19/02*** | (2006.01) |
| ***F02B 55/02*** | (2006.01) |
| *F02B 53/00* | (2006.01) |

(58) Field of Classification Search
USPC ..... 418/77, 195, 207; 123/221, 232, 233
See application file for complete search history.

(56) References Cited

FOREIGN PATENT DOCUMENTS

| | | |
|---|---|---|
| EP | 0 933 500 | 8/1999 |
| GB | 1068067 | 7/1964 |
| WO | 91/14859 | 10/1991 |
| WO | 2007/093818 | 8/2007 |
| WO | 2010/023487 | 3/2010 |

OTHER PUBLICATIONS

International Search Report dated Oct. 26, 2015 in corresponding International Application No. PCT/GB2015/052150.

* cited by examiner

ROTARY PISTON AND CYLINDER DEVICE

TECHNICAL FIELD

The present invention relates to rotary piston and cylinder devices

BACKGROUND

Rotary piston and cylinder devices can take the form of an internal combustion engine, or a compressor such as a supercharger or fluid pump, or as an expander such as a steam engine or turbine replacement, and as a positive displacement device.

A rotary piston and cylinder device comprises a rotor and a stator, the stator at least partially defining an annular chamber/cylinder space, the rotor may be in the form of a ring, and the rotor comprising at least one piston which extends from the rotor into the annular cylinder space, in use the at least one piston is moved circumferentially through the annular cylinder space on rotation of the rotor relative to the stator, the rotor being sealed relative to the stator, and the device further comprising cylinder space shutter means which is capable of being moved relative to the stator to a closed position in which the shutter means partitions the annular cylinder space, and to an open position in which the shutter means permits passage of the at least one piston, the cylinder space shutter means comprising a shutter disc.

We have devised improved sealing arrangements for such devices.

SUMMARY

According to the invention there is provided a rotary piston and cylinder device comprising a rotor, a stator and a shutter disc, the rotor comprising a piston which extends from the rotor into the cylinder space, the rotor and the stator together defining the cylinder space, the shutter disc passing through the cylinder space and forming a partition therein, and the disc comprising a slot which allows passage of the blade therethrough, the shutter disc comprising a circumferential surface arranged to form a seal with a surface of the rotor, the circumferential surface defining a profile which forms at least one close running line with said rotor surface, and the at least one close-running line offset from a plane which lies on a radius of the rotor and which contains the axis of rotation of the rotor.

The circumferential surface may be viewed as the outmost surface which extends around the disc.

The term 'piston' is used herein in its widest sense to include, where the context admits, a partition capable of moving relative to a cylinder wall, and such partition need not generally be of substantial thickness in the direction of relative movement but can be in the form of a blade. The partition may be of substantial thickness or may be hollow. The shutter disc may present a partition which extends substantially radially of the cylinder space.

The term seal is used herein to include an arrangement which reduces clearance, minimising leakage, but not necessary preventing fluid transfer across the seal. Close running line/region refers to a region formed at the sealing interface between the disc and the rotor Although in theory the shutter means could be reciprocable, it is preferred to avoid the use of reciprocating components, particularly when high speeds are required, and the shutter means is preferably at least one rotary shutter disc provided with at least one aperture which in the open condition of the shutter means is arranged to be positioned substantially in register with the circumferentially-extending bore of the annular cylinder space to permit passage of the at least one piston through the shutter disc.

The at least one aperture of the shutter is provided substantially radially in the shutter disc.

Preferably the axis of rotation of the rotor is non-parallel to the axis of rotation of the shutter disc. Most preferably the axis of rotation of the rotor is substantially orthogonal to the axis of rotation of the shutter disc.

Preferably the piston is so shaped that it will pass through an aperture in the moving shutter means, without balking, as the aperture passes through the annular cylinder space. The piston is preferably shaped so that there is minimal clearance between the piston and the aperture in the shutter means, such that a seal is formed as the piston passes through the aperture. A seal may be provided on a leading or trailing surface or edge of the piston. In the case of a compressor a seal could be provided on a leading surface and in the case of an expander a seal could be provided on a trailing surface.

The rotor is preferably rotatably supported by the stator rather than relying on co-operation between the pistons and the cylinder walls to relatively position the rotor body and stator. It will be appreciated that a rotary piston and cylinder device is distinct from a conventional reciprocating piston device in which the piston is maintained coaxial with the cylinder by suitable piston rings which give rise to relatively high friction forces.

The seal between the rotor and the circumferential surface of the shutter disc is preferably provided by a sealing gap therebetween, to minimise transmission of fluid.

The rotor may be rotatably supported by suitable bearing means carried by the stator.

Preferably the stator comprises at least one inlet port and at least one outlet port.

Preferably at least one of the ports is substantially adjacent to the shutter means.

Preferably the ratio of the angular velocity of the rotor to the angular velocity of the shutter disc is 1:1, although other ratios are possible.

The rotor may comprise a (circular) concave surface which defines, in part, with the stator, the cylinder space. The rotor may comprise a central aperture to allow a rotational transmission between the disc and the rotor to extend therethrough.

The shutter disc may be arranged to extend through the cylinder space at one region of the cylinder space.

The shutter disc may have a mid-plane which can be considered as a plane which extends generally midway of the height/depth of the disc.

The device may comprise one or more features described in the description below and/or shown in the drawings.

BRIEF DESCRIPTION OF DRAWINGS

Various embodiments of the invention will now be described, by way of example only, with reference to the following drawings.

DETAILED DESCRIPTION

Figure 1:
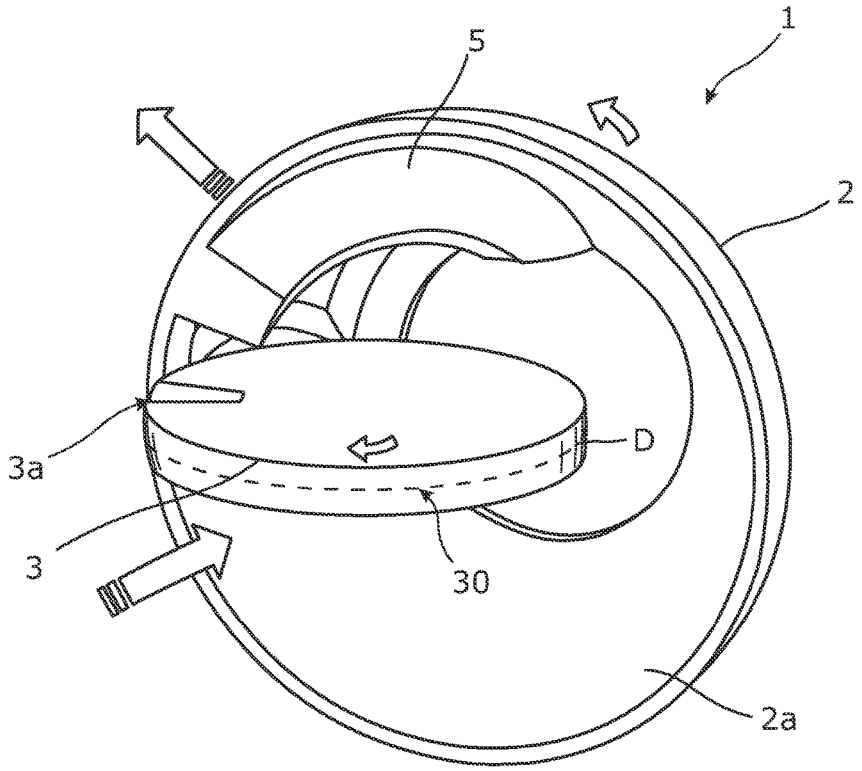
FIG. 1 is a perspective view of a rotary piston and cylinder device.

Reference is made to FIG. 1 which shows a rotary piston and cylinder device 1 which comprises a rotor 2, a stator (not shown), and a shutter disc 3. The stator comprises a formation which is maintained relative to the rotor, and an internal surface of the stator facing the surface 2*a* of the rotor, together define a cylinder space. The stator may further comprise a second portion which is located to the other side of the rotor, and so the stator portions together effectively enclose the rotor therebetween integral with the rotor and extending from the surface 2*a* there is provided a blade 5. A slot 3*a* provided in the shutter disc 3 is sized and shaped to allow passage of the blade therethrough. Rotation of the shutter disc 3 is geared to the rotor by way of a transmission assembly to ensure that the timing of the rotor remains in synchrony with the shutter disc.

In use of the device, a circumferential surface 30 of the shutter disc faces the inner surface 2*a* of the rotor so as to provide a seal therebetween, and so enable the shutter disc's functionality to serve as a partition within the cylinder space to be achieved. In the embodiments described below, aspects of the positioning of the shutter disc and the shape of the circumferential surface are disclosed.

In the exemplary embodiments described below we provide advantageous arrangements for the geometry defining the close-running line. "Close-running line" includes reference to a (substantially connected) set of points on the shutter disc that provide a substantially minimal clearance between the rotor and disc. The embodiments below illustrate the preferred geometry for several configurations of the rotary cylinder device, and it will be readily appreciated that variants embodying the underlying principle are also possible.

Figure 12A:
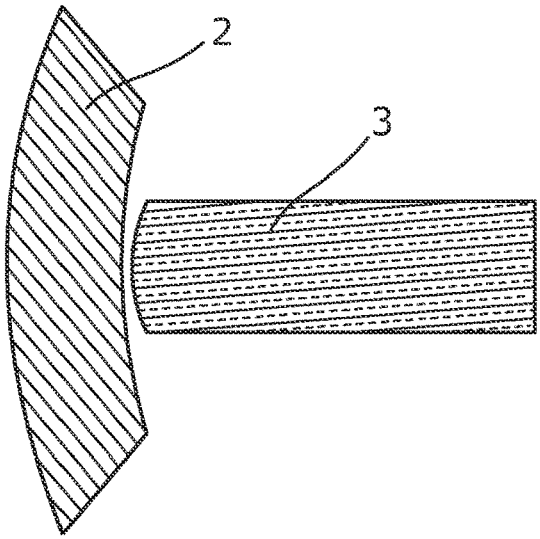
FIGS. 12*a* and 12*b* are snapshot detail views of different clearances between the shutter disc and the rotor of a rotary piston and cylinder device.
Figure 12B:
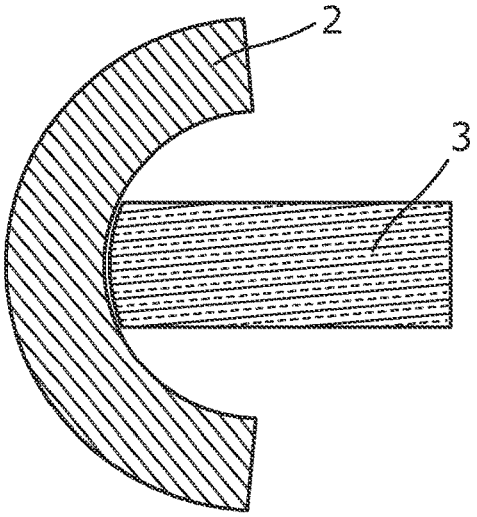

The geometry of the interior surface 2*a* of the rotor is governed by the curved circumferential surface of the rotating shutter disc. Since the disc (preferably) penetrates only one side of the (annular) cylinder, the axes of the disc and rotor will not generally intersect. Since the disc will also have a thickness, it will be understood that it cannot form a uniform seal clearance along the entirety of its outer face. This is a result of offset axes and chamber geometries of machines of this type, and the effect is demonstrated in FIGS. 12*a* and 12*b*, respectively. The Figures are exaggerated for clarity, on radial cross sections of the disc, which has a single central CRL. In this instance FIG. 12*a* shows the clearance at the inner diameter of FIG. 1, and FIG. 12*b* shows the clearance at the outer diameter of FIG. 1. At the outer position the radius of the rotor curvature relative to the disc is smaller, and the disc outer surface hence matches the rotor curvature very closely at this point. At the inner position the radius of the rotor curvature relative to the disc is larger, meaning that the clearances of the lead-in and lead-out are larger, since the disc curvature is unchanged. The clearance at the CRL is also unchanged, and substantially constant between the illustrated positions. It will be understood that these figures show clearances for a particular embodiment only, but that similar behaviour will be observed for other embodiments.

Figure 2:
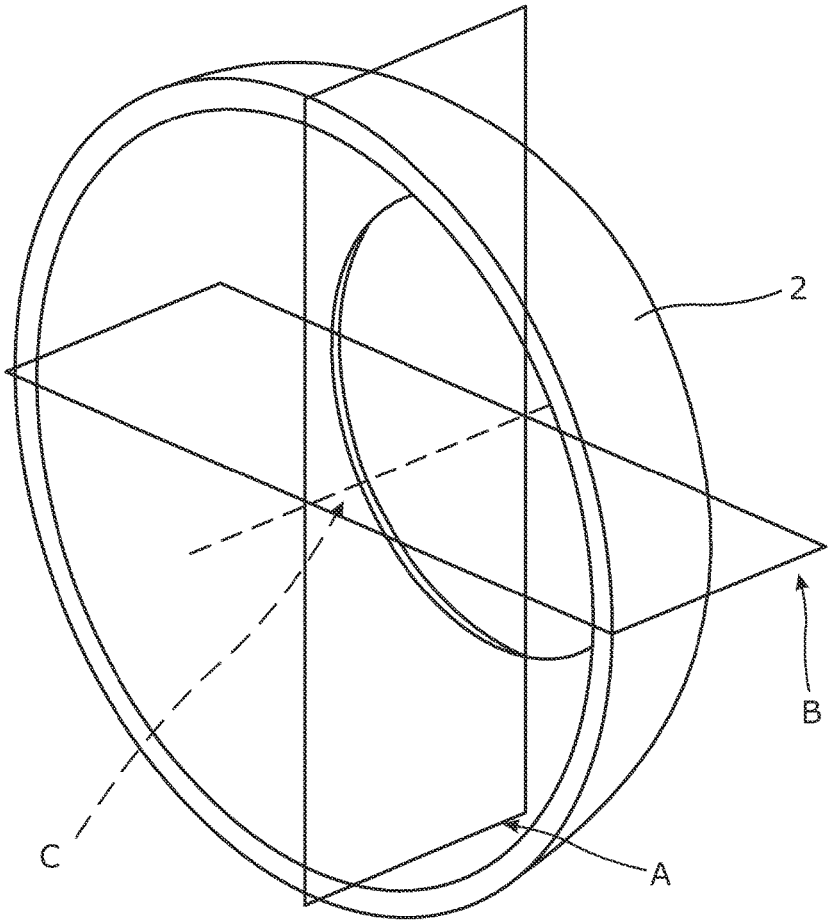
FIG. 2 is a perspective view of a rotor of the device of FIG. 1 showing various planes and an axis of rotation of the rotor.

A solution to designing the geometry of the surfaces of the disc and the rotor apparent to one skilled in the art is to define a plane coincident with the centre plane of the rotor, and for the circular curve defining the close-running line to be fully contained within this plane. The centre plane of the rotor 2 can also be considered as a radial plane, which is coincident with the axis of the rotor. Reference is made to FIG. 2 which shows the planes, denoted A and B and the axis of rotation of the rotor, denoted C. The circular curve is part of the circumference of the disc, and is then used to define the inner profile of the rotor, by revolving it around the rotor axis to form a surface. The outer face of the disc can then be created by determining a profile that reduces, or minimises, the gap between the circumferential surface of the disc and the inner surface of the rotor, while avoiding any contact between the two.

It will be apparent that one method to define such a profile is by using the inner surface 2*a* of the rotor, revolving it around the axis of the disc as a cutting surface. While this provides the optimum surface for a given device configuration, it is harder to manufacture and inspect. We have therefore realised that it is preferable that the circumferential surface of the disc is instead approximated to such an optimal surface by one or a set of simpler curves or radii that can be mathematically described.

It will be understood that other methods of forming such a geometry are possible, and that the descriptions of the embodiments may be realised by any other method that results in substantially similar geometry.

In the embodiment shown in FIG. 1, a shutter disc is mounted centrally with respect to the rotor i.e. on the plane B, such that central plane D (shown in FIG. 1) of the disc coincides with the axis of the rotor and hence its radial plane. The central plane of the disc passes through the midpoint (relative to the respective thickness/height of the circumferential surface) around the circumferential surface. In that configuration, the state of the art solution would be for the close-running line to be on said central disc plane, or mid-plane, resulting in a rotor inner face that can be defined by a single radius curve centred on the axis of the disc. The mid-plane of the disc may be defined as a plane which passes through the disc and is located substantially midway of the depth/height of the circumferential surface of the disc (or portion thereof) for at least part of the circumferential extent of said surface. If the circumferential surface is of variable height/depth, then the plane is located substantially midway of a major portion of the surface. This simple geometry is beneficial for manufacture and inspection. In contrast, in the embodiments described below, the close-running line is offset from that (central) plane.

Figure 2A:
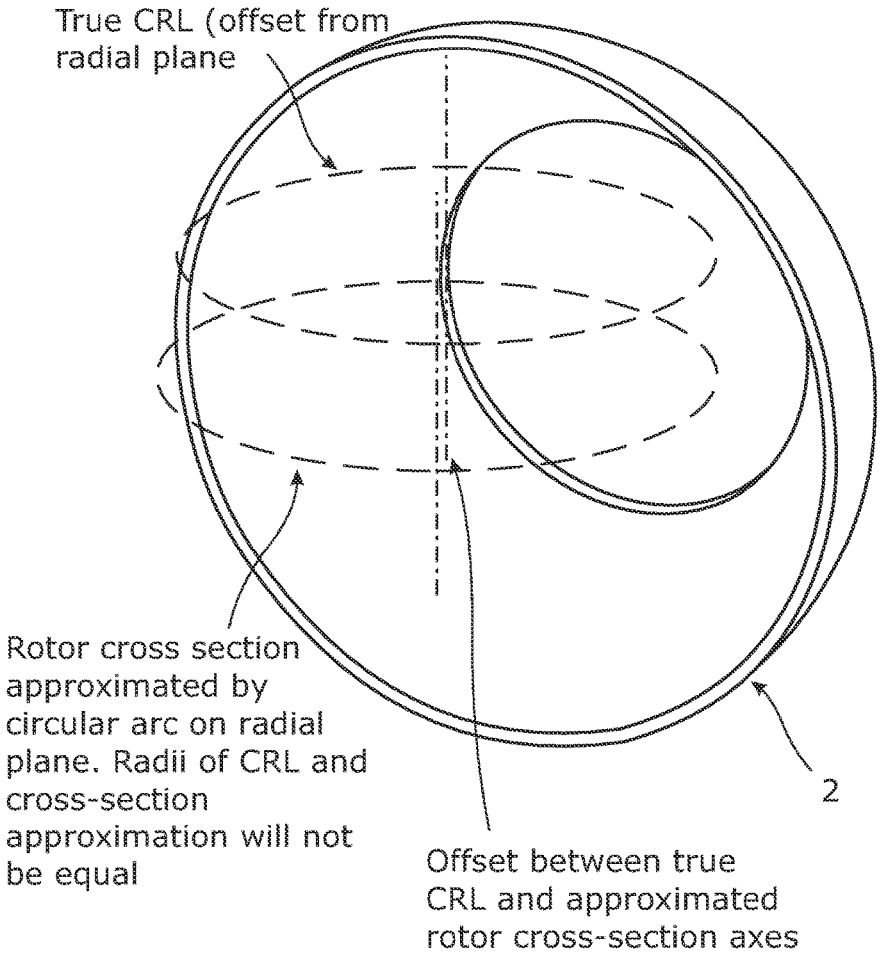
FIG. 2*a* is a schematic to illustrated a preferred method of generating a rotor radial cross-section.

With reference to FIG. 2*a*, in the case of a close-running line being offset from the rotor radial plane, as described herein, the ideal radial cross-section of the rotor is in fact substantially elliptical. For ease of manufacture, however, it can be approximated by a circular (single-radius) arc of a generally larger diameter and with an axis offset from that of the CRL. In many configurations the error of this approximation is very low, and allowing for easier specification of tool paths for manufacture and inspection.

Figure 3:
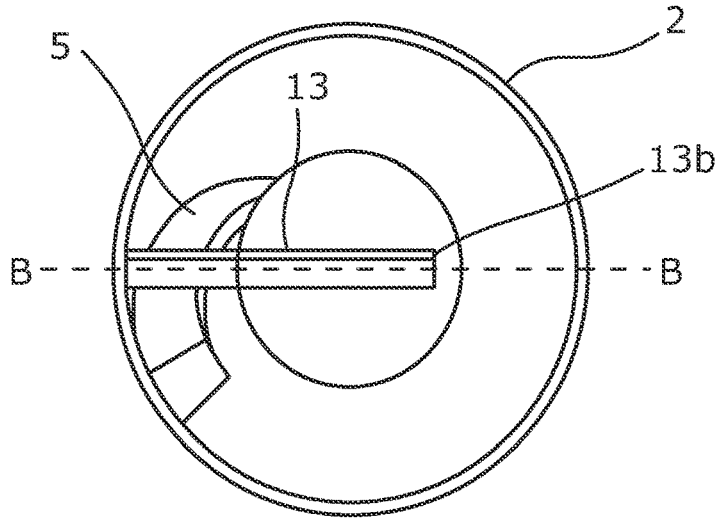
FIGS. 3 and 4 are perspective and side views of a rotary piston and cylinder device which includes an offset close-running line.
Figure 4:
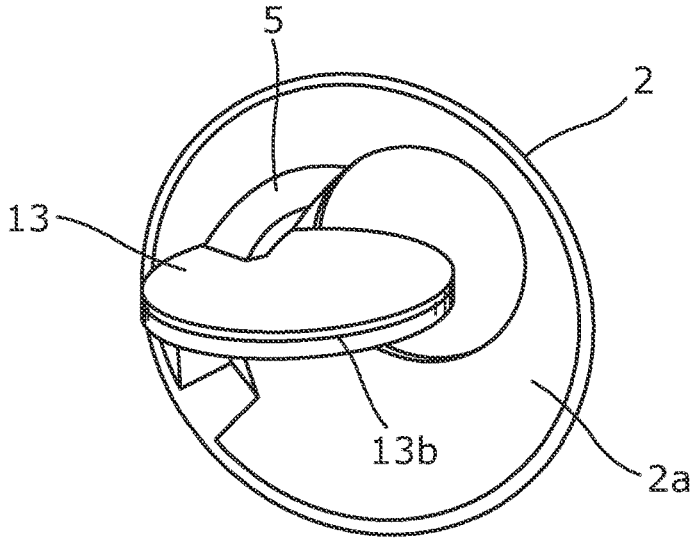

Reference is made to FIGS. 3 and 4 which show a centrally mounted shutter disc 13, but with a circumferential surface having a profile which defines a close-running line 13*b* which is offset from the plane B of FIG. 2, but in which the central plane of the disc is coincident with the plane B.

Figure 5:
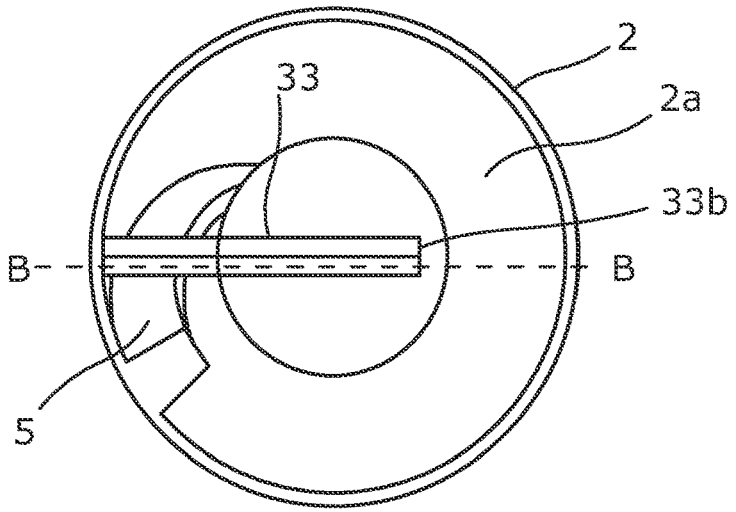
FIG. 5 is a front view of a rotary piston and cylinder device which comprises an offset close-running line, and is a variant embodiment of the device shown in FIGS. 3 and 4, FIGS. 6 and 7 are front and perspective views respectively of a rotary piston and cylinder device comprising two offset close running lines.

FIG. 5 shows an embodiment in which the close-running line is central of the thickness of a shutter disc 33, but the central plane of the shutter disc is offset from the plane B.

Figure 6:
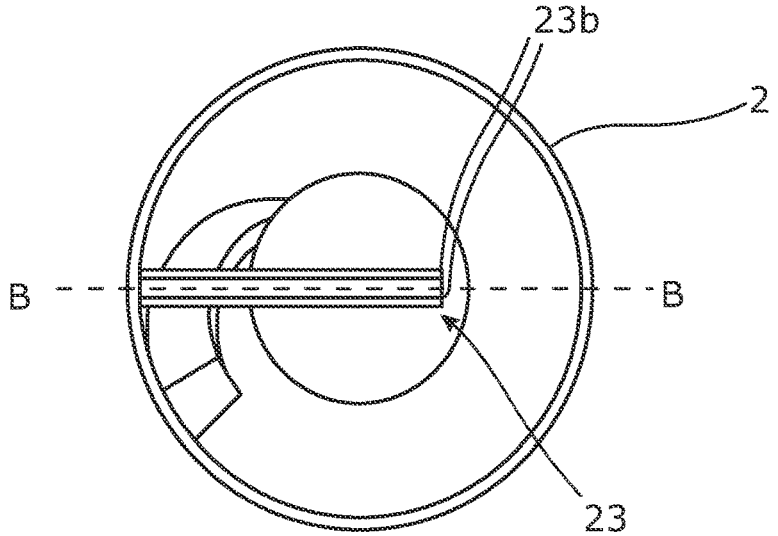
Figure 7:
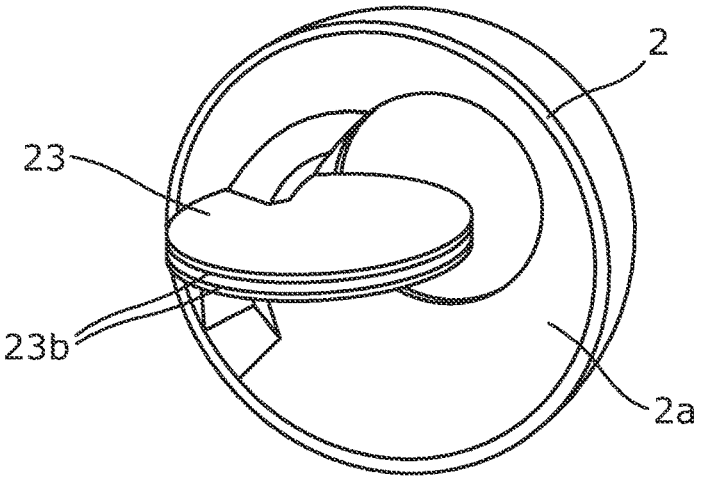

Turning to FIGS. 6 and 7, there is shown a rotary piston and cylinder device comprising a shutter disc 23, of which the circumferential surface is provided with two spaced-apart close-running lines, 23*b*. The close-running lines are spaced about the central plane of the disc, and the central plane of the disc is coincident with the plane B. From this, each of the close-running lines 23*b* is offset from the plane B, in symmetrical fashion. Although such a solution increases the complexity of defining the surface of the disc the symmetry of the configuration allows two close-running lines to be present symmetrically either side of the rotor radial plane. Having two close-running lines significantly improves sealing of the rotary cylinder, since the disc-rotor sealing gap presents a leak path for the majority of the stroke.

Figure 8:
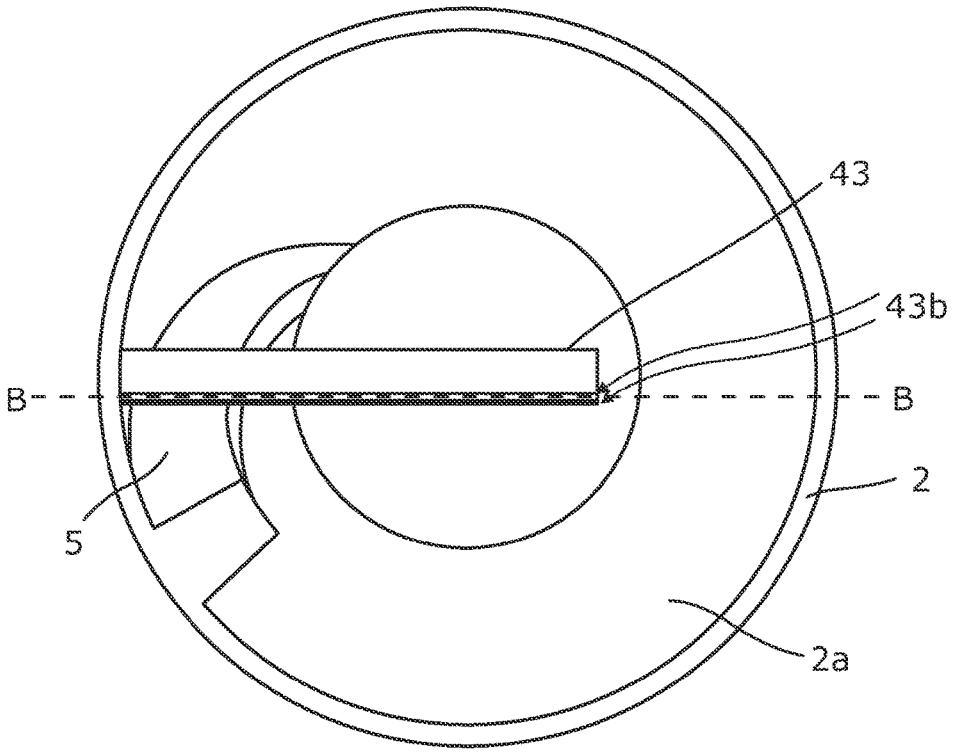
FIG. 8 is a front view of a rotary piston and cylinder device comprising two close-running lines, which each are offset, and in which the shutter disc is offset (from a radial plane of the rotor)

FIG. 8 shows a rotary piston and cylinder device comprising a shutter disc 43, which comprises two close-running lines 43*b*, the close running lines being symmetrically located about the plane B, and the central plane of the disc being offset from the plane B.

Figure 9:
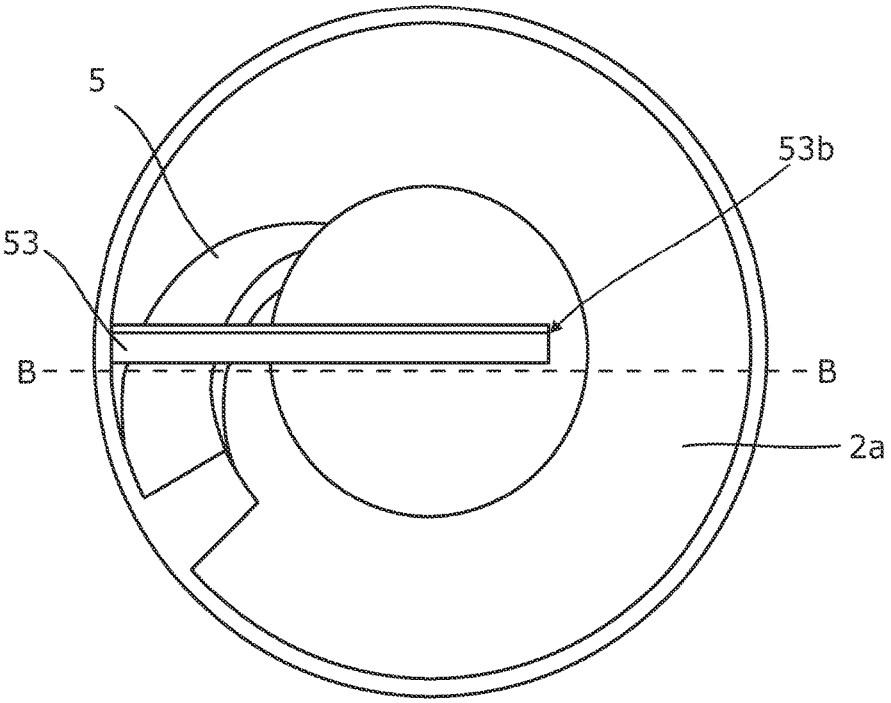
FIG. 9 is a front view of a rotary piston and cylinder device comprising a single close running line in which both the disc and the close-running are offset from a radial plane of the rotor.
Figure 10:
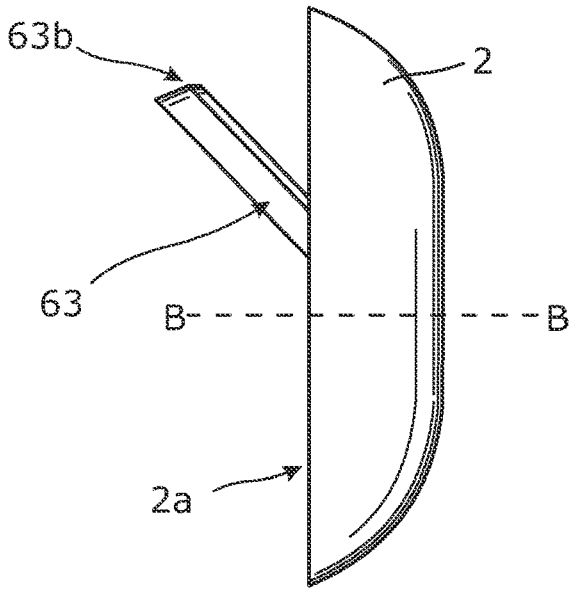
FIGS. 10 and 11 are side and front views respectively of a rotary piston and cylinder device in which the shutter disc is inclined to the radial plane of the rotor.
Figure 11:
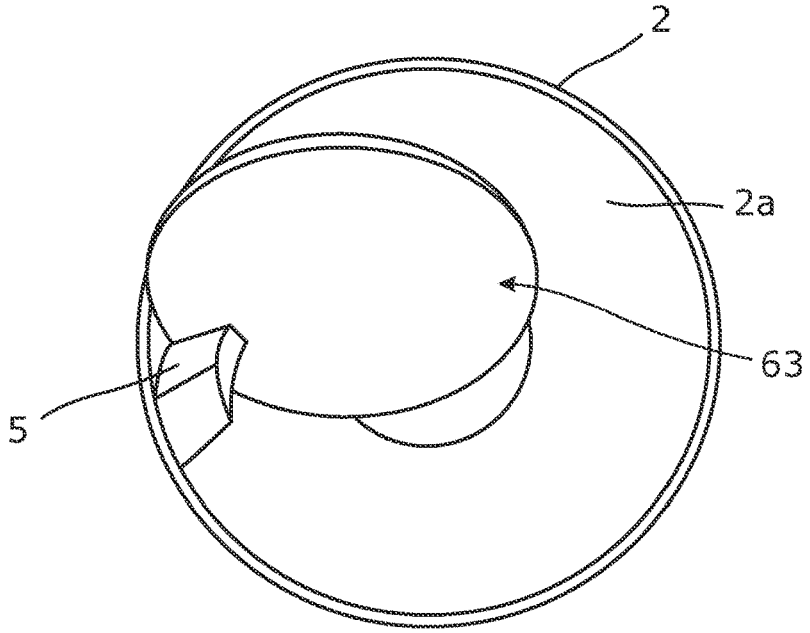

FIG. 9 shows an embodiment in which a shutter disc 53 is offset from the central plane B, and its close-running line is offset from the central plane of the disc. In this configuration the disc is offset beyond the rotor plane, so as to not intersect or overlap with the rotor plane B, the extent of close-running line offset should be greater still. In such a scenario it is not possible to provide more than one close-running line, however positioning the single close-running line offset from the disc central plane is nevertheless beneficial. The benefit relates to the disc circumferential surface portions, each side of the close-running line, since these become substantially closer to the rotor face if the close-running line is offset from the disc central plane in the direction that makes it further still from the rotor axis. When these faces (i.e. the circumferential surface and the rotor surface) are closer, leakage through the gap is reduced, even though the clearance (between the circumferential surface and the rotor) at the close-running line is unchanged. It will be understood that the exact amount by which the close-running line is offset from the disc central plane is dependent on the particular device configuration. Other factors such as seal wear, tolerance stack-up and deformation in service, are also influential In FIGS. 10 and 11, there is shown a rotary piston and cylinder device in which a shutter disc 63 is not orthogonal to a normal plane of the rotar, and having a close-running line 63*b* such that the close running line is offset in the direction shown in the Figure. This tilted configuration can improve the packaging of the device. This reduces the number of gear interfaces, and can increase efficiency of the device. Offsetting the sealing plane away from the disc central plane substantially reduces the distance between the faces either side of the sealing line and the rotor inner face, and thereby improves sealing.

In those embodiments in which the shutter disc central plane is offset and/or angled from the rotor plane, there can be packaging/benefits for the transmission assembly connecting the shutter disc to the rotor.

Figure 14:
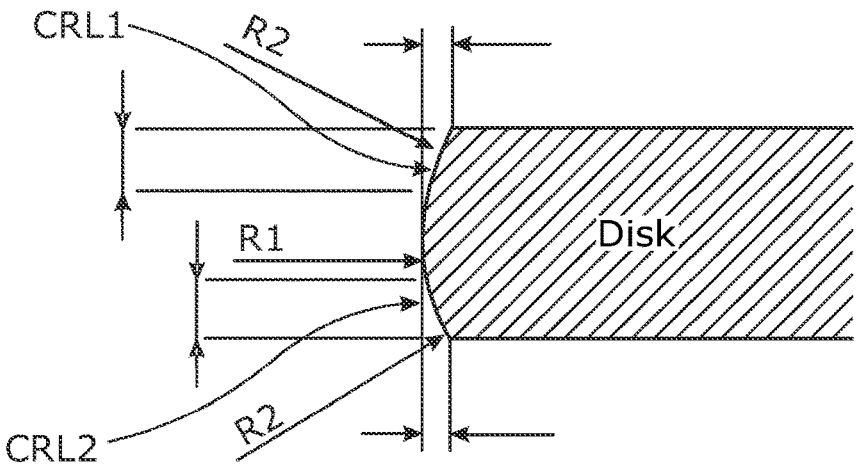
FIG. 14 is a cross-sectional profile of a circumferential surface of a shutter disc of a rotary piston and cylinder device, showing different radiused portions.

Referring now to FIGS. 13*a*, to 13*d*, FIG. 14 and FIGS. 15*a* to 15*c* various examples of the circumferential surface shape/geometry of the shutter disc are shown. In FIG. 14, which shows a central disc with two close-running lines it can be seen that the circumferential surface comprises a series of three radiused portions, R1 and R2. R1 is an intermediate portion which is flanked by portions R2. The portions are contiguous, and serve to approximate to the optimal surface profile, albeit in a manner which is readily defined mathematically by reference to the respective radii, and the arcuate extent of each. At each end of the intermediate portion R1 a close-running line is formed, at its closest regions to the rotor surface. It can be seen the radius of R1 is greater than the radius of R2. Having three (or indeed more generally, multiple) single-radius curves provides significant benefits for both manufacture and inspection. It will be appreciated that the approximation of ideal curves to a series of single radius curves simplifies inspection procedures.

Figure 13D:
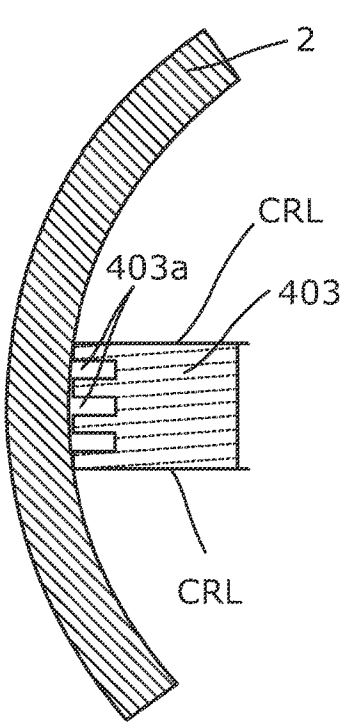
FIGS. 13*a* to 13*d* show cross-sectional views of different shutter disc surface geometries.
Figure 13C:
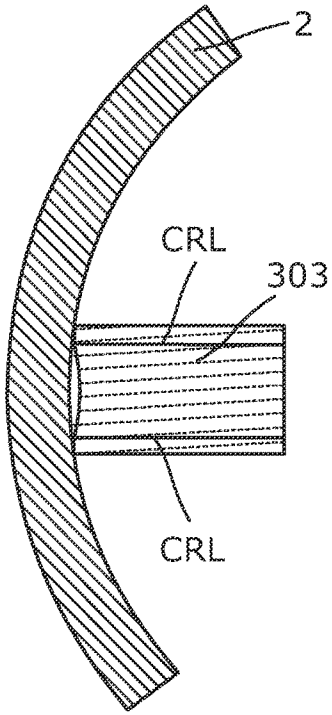
Figure 13B:
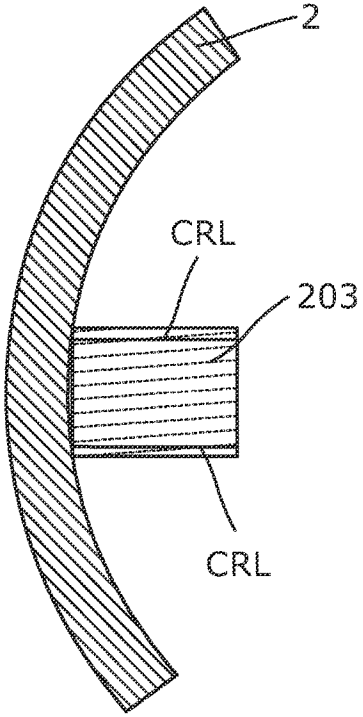
Figure 13A:
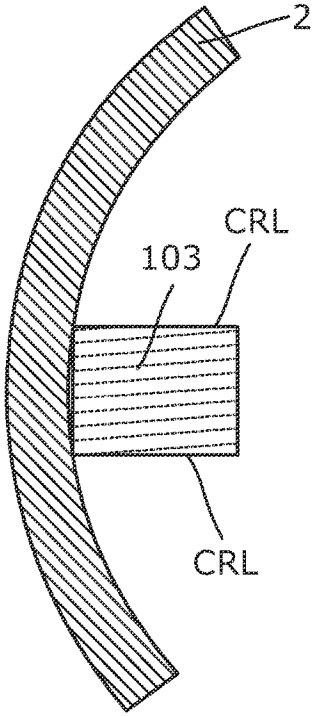

In FIG. 13*a*, a shutter disc 103 with a square shape is shown, which results in two close-running lines. In FIG. 13*b*, a circumferential surface of a shutter disc 203 is provided with a flat profile, and provided with radiused shoulder portions. In FIG. 13*c*, the circumferential surface comprises a concave portion and radiused shoulders. In FIG. 13*d*, a shutter disc 403, is based on the geometry of the circumferential surface of the disc 103, save that a plurality of recesses 403*a* are provided. This may be viewed as a straight (when viewed in cross-section) geometry, which is provided with the recesses.

Figure 15C:
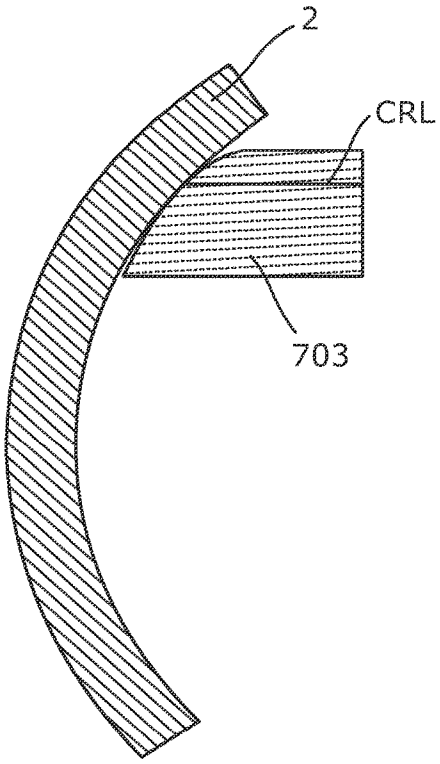
FIGS. 15*a* to 15*c* are cross-sectional views of different shutter disc surface geometries in different positions relative to the central plane of the rotor.
Figure 15B:
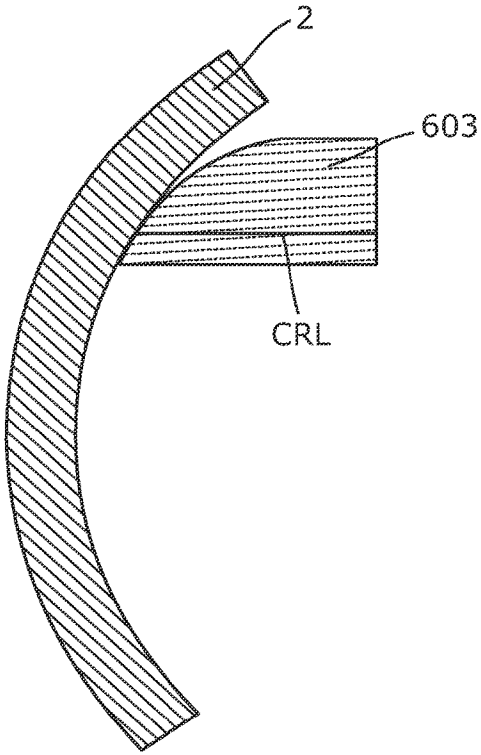
Figure 15A:
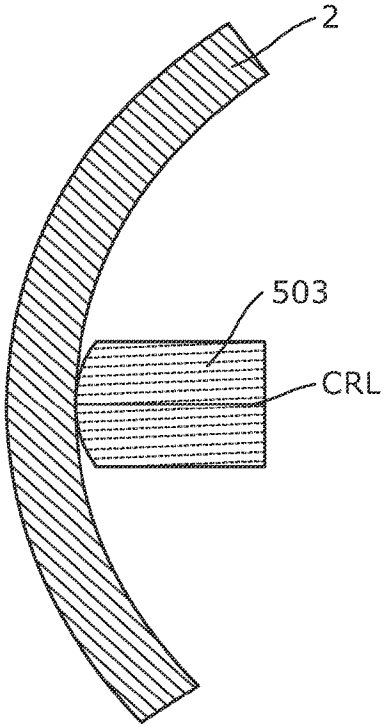

FIG. 15*a* shows a shutter disc 503 which is provided with a radiused face, and which provides a single close-running line, which is not offset from the central plane of the rotor, and is shown as a comparison reference to illustrate the extent of offset shown in FIGS. 15*b* and 15*c*. FIG. 15*b* shows a shutter disc 603 with an asymmetric curved surface, in which both the shutter disc and the close-running line are offset from the central rotor plane 13. FIG. 15*c* shows a similar type of arrangement, however the curved geometry of the face of the disc 703 differs from that of the disc 603, to the extent that the close running line is positioned differently.

Figure 16:
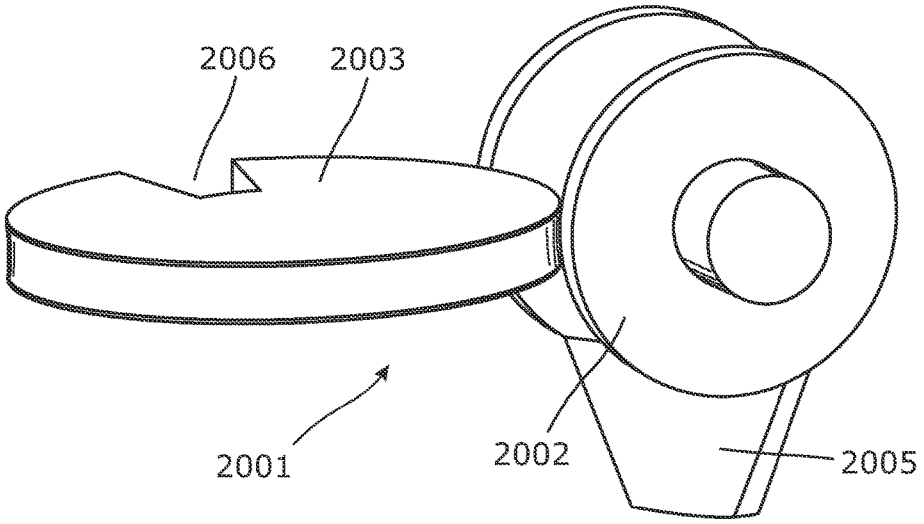
FIG. 16 is a (partial) perspective view of a second type of rotary piston and cylinder device.
Figure 17A:
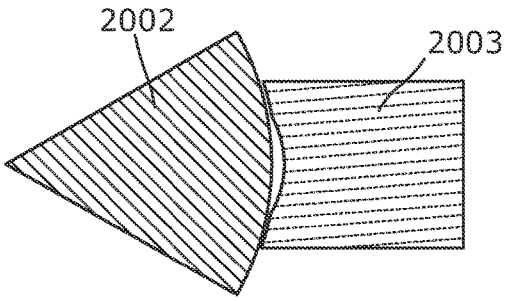
FIGS. 17*a* and 17B are cross-section views of the rotor and the shutter disc of the device in FIG. 16.
Figure 17B:
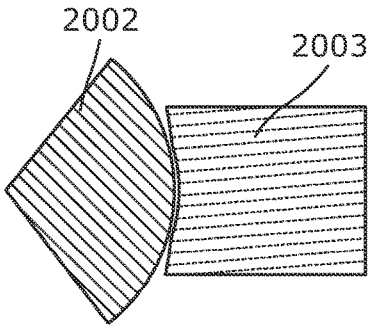

Reference is made to FIG. 16 which shows a further type of rotary piston and cylinder device in which a rotor 2002 comprises a piston 2005, wherein the piston passes through a slot 2006 provided in the shutter disc 2003. An encasing stator structure is omitted for clarity. As can be seen in FIG. 17, exaggerated for clarity, the circumferential surface of the disc is of generally concave shape, presenting two close-running lines with the rotor surface. The two CRLs are present around the central plane of the disc. In this embodiment the disc is centred on a rotor radial plane, and two CRLs are present around its central plane, as described above. Both views are taken on radial sections of the disc. At the inner diameter of the rotor, the curvature of the rotor as seen from the disc is minimal, and thus determines the curvature of the central portion of the disc outer surface. At the outer diameter of the rotor, the curvature of the rotor as seen from the disc is maximal, and hence determines the curvature of the outer portions of the disc outer surface. It will be appreciated that between these two extremes, the curvatures of the disc and rotor surfaces will not match, but that clearance at the CRL's will be substantially constant and minimal. It will therefore be apparent that the principle of offsetting the close-running line(s) is also beneficial when used in other types of rotary piston and cylinder devices.

The invention claimed is:

1. A rotary piston and cylinder device comprising a rotor, a stator and a shutter disc, the rotor comprising a piston which extends from the rotor into a cylinder space, the rotor and the stator together defining the cylinder space, the shutter disc passing through the cylinder space and forming a partition therein, and the shutter disc comprising a slot which allows passage of the piston therethrough, the shutter disc comprising a circumferential surface arranged to define a sealing gap with an inside surface of the rotor, the circumferential surface defining a profile which forms at least one close running line with said rotor surface, and the at least one close-running line offset from a rotor plane which lies on a radius of the rotor and which includes an axis of rotation of the rotor, and wherein the sealing gap presents a leak path for a majority of a stroke of said piston.

2. The rotary piston and cylinder device as claimed in claim 1 in which a central disc plane of the shutter disc lies in a plane which is substantially parallel to the rotor plane.

3. The rotary piston and cylinder device as claimed in claim 1 in which a central disc plane of the shutter disc is substantially central of the rotor plane.

4. The rotary piston and cylinder device as claimed in claim 1 in which the shutter disc is offset from the rotor plane.

5. The rotary piston and cylinder device as claimed in claim 1 in which the shutter disc does not intersect the rotor plane.

6. The rotary piston and cylinder device as claimed in claim 5 in which the shutter disc does not intersect a parallel rotor radial plane.

7. The rotary piston and device as claimed in claim 1 in which the shutter disc is inclined relative to the rotor plane.

8. The rotary piston and cylinder device as claimed claim 1 in which the shutter disc comprises the circumferential surface which defines two spaced apart close running lines.

9. The rotary piston and cylinder device as claimed in claim 8 in which the close running lines are spaced apart in the direction of a thickness dimension of the disc.

10. The rotary piston and cylinder device as claimed in claim 8 in which the close running lines are symmetrical about the rotor plane.

11. The rotary piston and cylinder device as claimed in claim 1 in which the shutter disc arranged to provide two spaced apart close-running lines with the rotor, and the mid-plane of the disc is offset from a radial plane of the rotor.

12. The rotary piston and cylinder device as claimed in claim 1 in which a cross-sectional profile of the circumferential surface, taken on a radius of the shutter disc, varies at different circumferential positions of the shutter disc.

13. The rotary piston and cylinder device as claimed in claim 12 in which the variance in profile at different circumferential positions of the shutter disc is such that a greater extent of the circumferential surface at one circumferential position is closer to the rotor surface as compared to that at another circumferential position.

14. The rotary piston and cylinder device as claimed in claim 1 in which a cross-sectional profile of the circumferential surface taken on a radius of the shutter disc comprises a plurality of contiguous radiused portions.

15. The rotary piston and cylinder device as claimed in claim 14 in which the circumferential surface comprises an intermediate radiused portion, positioned between two outer radiused portions, and the intermediate portion of greater radius than the outer portions.

16. The rotary piston and cylinder device as claimed in claim 1 in which the circumferential surface of the shutter disc comprises at least one of a plurality of radiused portions, a concave profile, a square profile, and one which includes a plurality of recessed formations.

17. The rotary piston and cylinder device as claimed in claim 1, in which the close-running line of the shutter disc is positioned such that a mid-plane of the disc is intermediate of the close-running line and the rotor plane.

18. The rotary piston and cylinder device as claimed in claim 1 in which the shutter disc partitions the cylinder space at one region of the cylinder space.

* * * * *